US006460729B2

(12) United States Patent
Beecroft

(10) Patent No.: US 6,460,729 B2
(45) Date of Patent: Oct. 8, 2002

(54) ONE-PIECE SIDE-DISPENSING CLOSURE

(75) Inventor: W. Gordon Beecroft, Leola, PA (US)

(73) Assignee: Doly-Seal Corporation, Baltimore, MD (US)

( * ) Notice: Subject to any disclaimer, the term of this patent is extended or adjusted under 35 U.S.C. 154(b) by 0 days.

(21) Appl. No.: 09/798,991

(22) Filed: Mar. 6, 2001

(65) Prior Publication Data

US 2002/0125274 A1 Sep. 12, 2002

(51) Int. Cl.[7] ..... B67D 3/00

(52) U.S. Cl. ..... 222/1; 222/556; 222/498; 222/536

(58) Field of Search ..... 222/536, 533, 222/534, 498, 556

(56) References Cited

U.S. PATENT DOCUMENTS

| | | | | |
|---|---|---|---|---|
| 1,985,587 A | * | 12/1934 | Storrs, Jr. | 220/326 |
| 3,516,581 A | | 6/1970 | Micallef | |
| 3,542,256 A | | 11/1970 | Waterman | |
| 4,607,768 A | * | 8/1986 | Taber et al. | 215/237 |
| 4,776,501 A | | 10/1988 | Ostrowsky | |
| 4,819,832 A | | 4/1989 | Lawson | |
| 4,962,869 A | | 10/1990 | Gross et al. | |
| 4,982,882 A | | 1/1991 | Gueret | |
| 5,022,566 A | | 6/1991 | Song et al. | |
| 5,065,912 A | | 11/1991 | Rosenthal | |
| 5,192,005 A | | 3/1993 | Zimmerman | |
| 5,236,107 A | | 8/1993 | Spaanstra, Sr. | |
| 5,273,177 A | * | 12/1993 | Campbell | 16/225 |
| 5,544,790 A | | 8/1996 | Lu | |
| 5,551,607 A | | 9/1996 | Dejonge, Sr. et al. | |
| 5,735,438 A | * | 4/1998 | Ostrowsky | 222/153.06 |
| 5,873,476 A | * | 2/1999 | Takahashi et al. | 215/237 |
| 5,996,859 A | | 12/1999 | Beck | |
| 6,253,938 B1 | * | 7/2001 | Zaksenberg et al. | 215/237 |

* cited by examiner

*Primary Examiner*—Henry C. Yuen
*Assistant Examiner*—Stephanie Willatt
(74) *Attorney, Agent, or Firm*—Dickstein Shapiro Morin & Oshinsky LLP

(57) ABSTRACT

A one-piece side-dispensing closure including a cap, a dispensing lid, and a flexible actuating section connected between the cap and the dispensing lid is described. The cap has an inner wall connectable with a container, a platform overlying the inner wall and having an aperture, a discharge tube positioned over the aperture, and a top wall supported by the platform. The dispensing lid includes a lever portion, a conduit portion formed on an end of the lid opposite the lever portion, a fulcrum about which the lid rotates, a connector for pivotally connecting the lid to the cap, and a fluid passageway formed in the conduit portion and connected to the discharge tube. The flexible actuating section is connected on its upper end to the dispensing lid by a top hinge and on its lower end to the cap by a bottom hinge. The closure is formed to permit transition from a closed position to an open position when a force is applied to the flexible actuating section.

50 Claims, 6 Drawing Sheets

ONE-PIECE SIDE-DISPENSING CLOSURE

FIELD OF THE INVENTION

The present invention relates to closures for containers, and more particularly to a method and apparatus for dispensing flowable materials from a container using a flexible actuator section on a side of the closure opposite the dispensing opening.

BACKGROUND

Many varieties of closures have been developed to attach to a container for the purpose of dispensing flowable materials. Among these varieties, press-to-open, side-dispensing closures have gained widespread use because of their relatively economical manufacture and ease of use by consumers. Closures of this type normally provide a supporting structure for attachment to a container and a pivoting nozzle with a dispensing passageway to deliver the contents of the container. These types of closures, although generally regarded as satisfactory, lack certain features.

One feature heretofore absent is the ability to conveniently dispense flowable materials from a heavy container with one hand. Prior closures which have addressed the one-handed actuation issue have required the user to actuate the closure at or near the top of the closure or on a side of the closure nearest the dispensing opening. For a heavy container, closures requiring top-actuation are inconvenient, due to the long moment arm between the container center-of-gravity and the location of the actuator. When only one hand is used to simultaneously hold a heavy container, orient it, and actuate the closure, this long moment arm forces increased effort by the user.

Closures permitting side-actuation on the same side as the dispensing opening are likewise inconvenient for dispensing readily flowable contents from a container, due to the increased effort required. To dispense accurately with such a closure mounted on a heavy container, the closure actuation is either followed by hand-repositioning, or awkward hand rotation. This type of closure also places the hand in the line of spillage from the closure dispensing opening.

In addition, for products sold and stored in the inverted position, conventional containers generally require several steps involving both hands in order to dispense the container contents. For example, the "tottle," so named because its shape which resembles a tube is actually that of a bottle, is currently a popular package for creams, shampoos, and lotions. The "tottle" may be stored and used in the inverted position. Conventionally, such closures generally require the user to invert the container in order to actuate the closure before the contents of the container may be dispensed. This inversion of the container usually requires the user to use two hands to invert the container, actuate the closure, and complete the intended dispensing operation.

Other features of importance for a closure are its economical use and efficient manufacture. The closure should be capable of use with conventional containers, permitting attachment to conventional container necks by conventional capping machines. Also, the closure should comprise as few parts as possible. The parts should be readily assembled with a minimum number of mechanical or manual operations and so structured that they can be fabricated at high speed in modern plastic injection molding machinery.

Thus, there is a desire and need for a closure that permits convenient side-actuation, permits ease of use with inverted containers, comprises as few parts as possible, and is easy to manufacture and use with conventional containers.

SUMMARY

The invention provides a one-piece side-dispensing closure including a cap, a dispensing lid, and a flexible actuating section connected between the cap and the dispensing lid. The cap has an inner wall connectable with a container, a platform overlying the inner wall and having an aperture, a discharge tube positioned over the aperture, and a top wall supported by the platform. The dispensing lid includes a lever portion, a conduit portion formed on an end of the lid opposite the lever portion, a fulcrum about which the lid rotates, a connector for pivotally connecting the lid to the cap, and a fluid passageway formed in the conduit portion and connected to the discharge tube. The flexible actuating section is connected on its upper end to the dispensing lid by a top hinge and on its lower end to the cap by a bottom hinge. The closure is formed to permit transition from a closed position to an open position when a force is applied to the flexible actuating section.

The invention further provides a system for dispensing flowable materials. The system includes a container and a closure having a cap, a dispensing lid, and a flexible actuating section.

The invention further provides a method for dispensing flowable materials from a container. The method includes the steps of connecting a one-piece side-dispensing closure, which includes a dispensing lid attached to a cap by a flexible actuating section and pivotally connected to the cap, to a container containing a flowable material, optionally orienting the container and the closure in a desired direction, applying a force to the actuating section situated opposite a dispensing opening of the lid to transition the lid from a closed position to an open position by rotating about a fulcrum, and permitting the flowable material to flow out of the container, through the cap, and out of the lid through the dispensing opening.

It is an object of the invention to provide a one-piece side-dispensing closure for a container.

It is a further object of the invention to provide a side-dispensing closure that is actuated on a side of the closure opposite its dispensing opening for convenient dispensing in a desired direction from a heavy container.

It is a further object of the invention to provide an efficiently-manufactured one-piece side-dispensing closure with annular seals preventing fluid flow when the closure is in a closed position and preventing fluid flow other than through the fluid passageway when the closure is in an open position and additionally tending to maintain the closure in a closed position when previously in a closed position and to maintain the closure in an open position when previously in an open position.

These and other features and advantages of the invention will be more readily understood from the following detailed description of the invention which is provided in connection with the accompanying drawings.

DETAILED DESCRIPTION OF PREFERRED EMBODIMENTS

Figure 1:
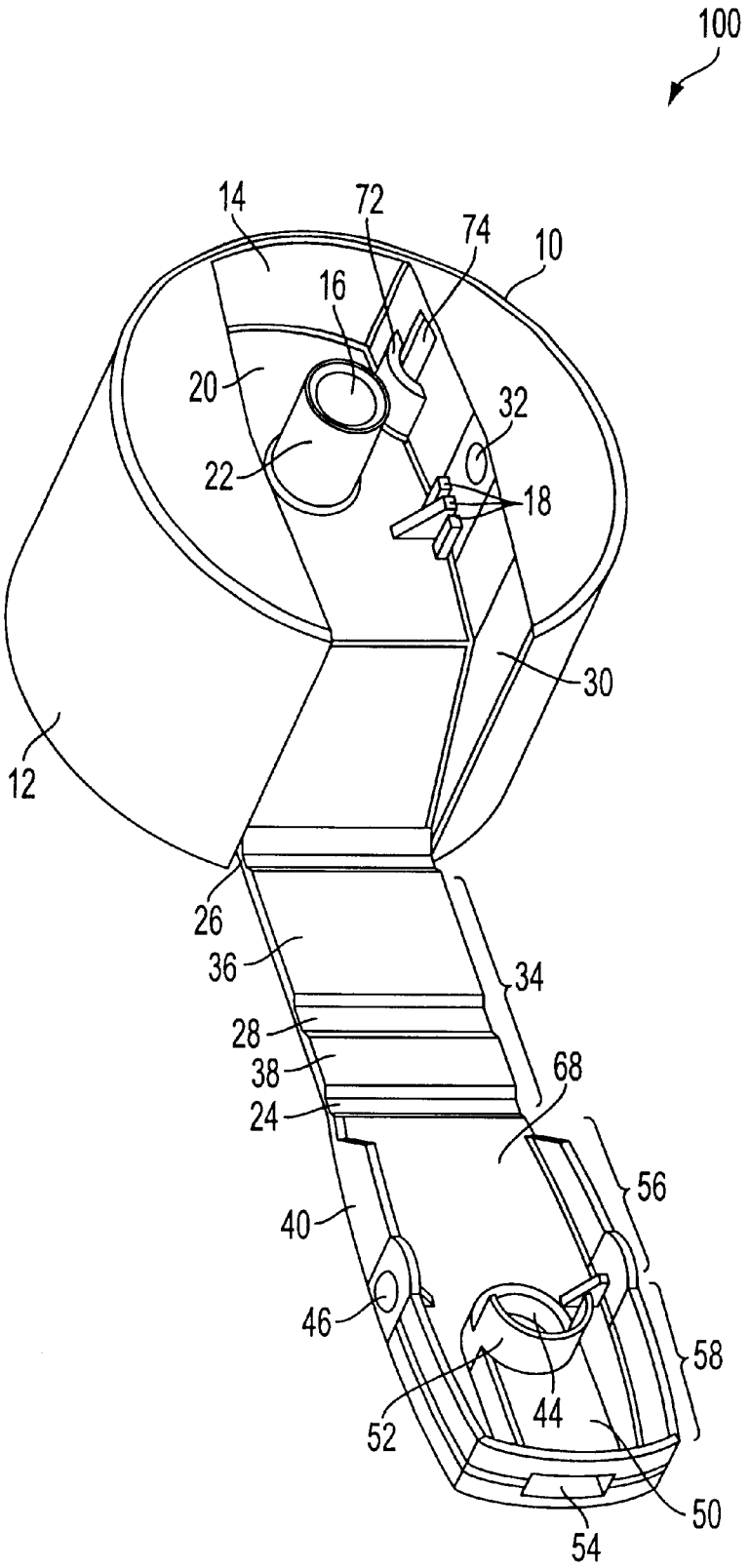
FIG. 1 is a perspective view of a partially assembled one-piece side-dispensing closure constructed in accordance with an embodiment of the invention.
Figure 2:
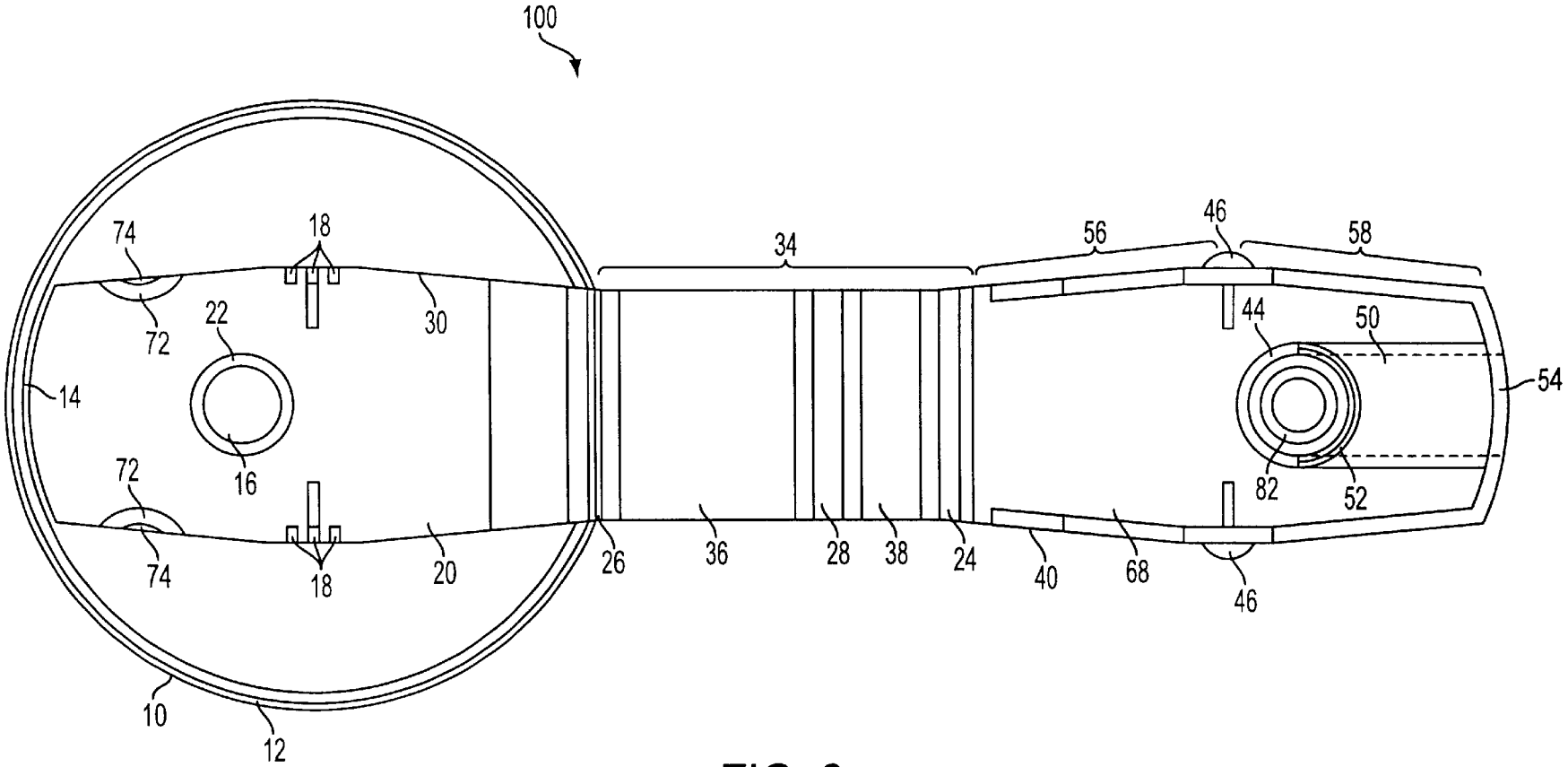
FIG. 2 is a top view of the closure illustrated in a FIG. 1.

With reference to FIGS. 1–7, a one-piece side-actuated, side-dispensing closure 100 is shown according to a preferred embodiment of the invention. As shown in FIGS. 1–2, the closure 100 includes a cap 10, a dispensing lid 40, and a flexible actuating section 34 that connects the cap 10 to the dispensing lid 40. The lid 40 is sized and configured to pivotally connect with the cap 10, for example using sockets 32 on the cap 10 and pivots 46 in the shape of balls on the lid 40. It is desirable that the closure 100 be molded in a conventional molding apparatus and that the cap 10 and the lid 40 be formed of a plastic material. It is also desirable that the cap 10, the lid 40, and the flexible actuating section 34 be formed as a single, unitary part.

Figure 3:
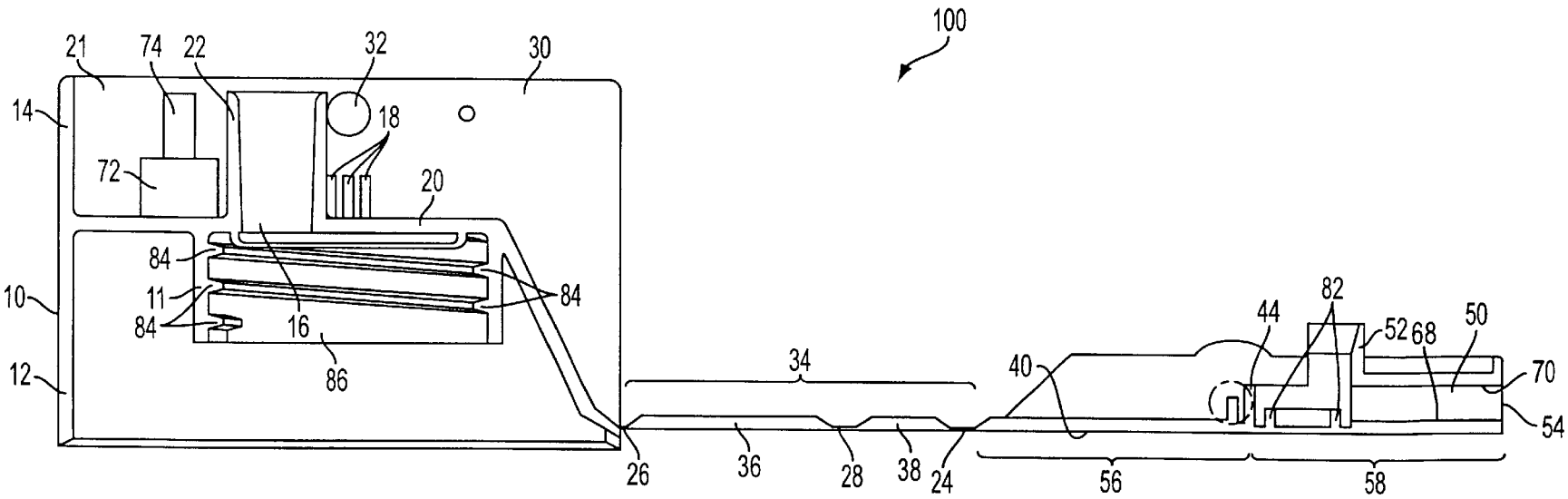
FIG. 3 is a cross-sectional view taken along the centerline of the closure illustrated in FIG. 2.
Figure 6:
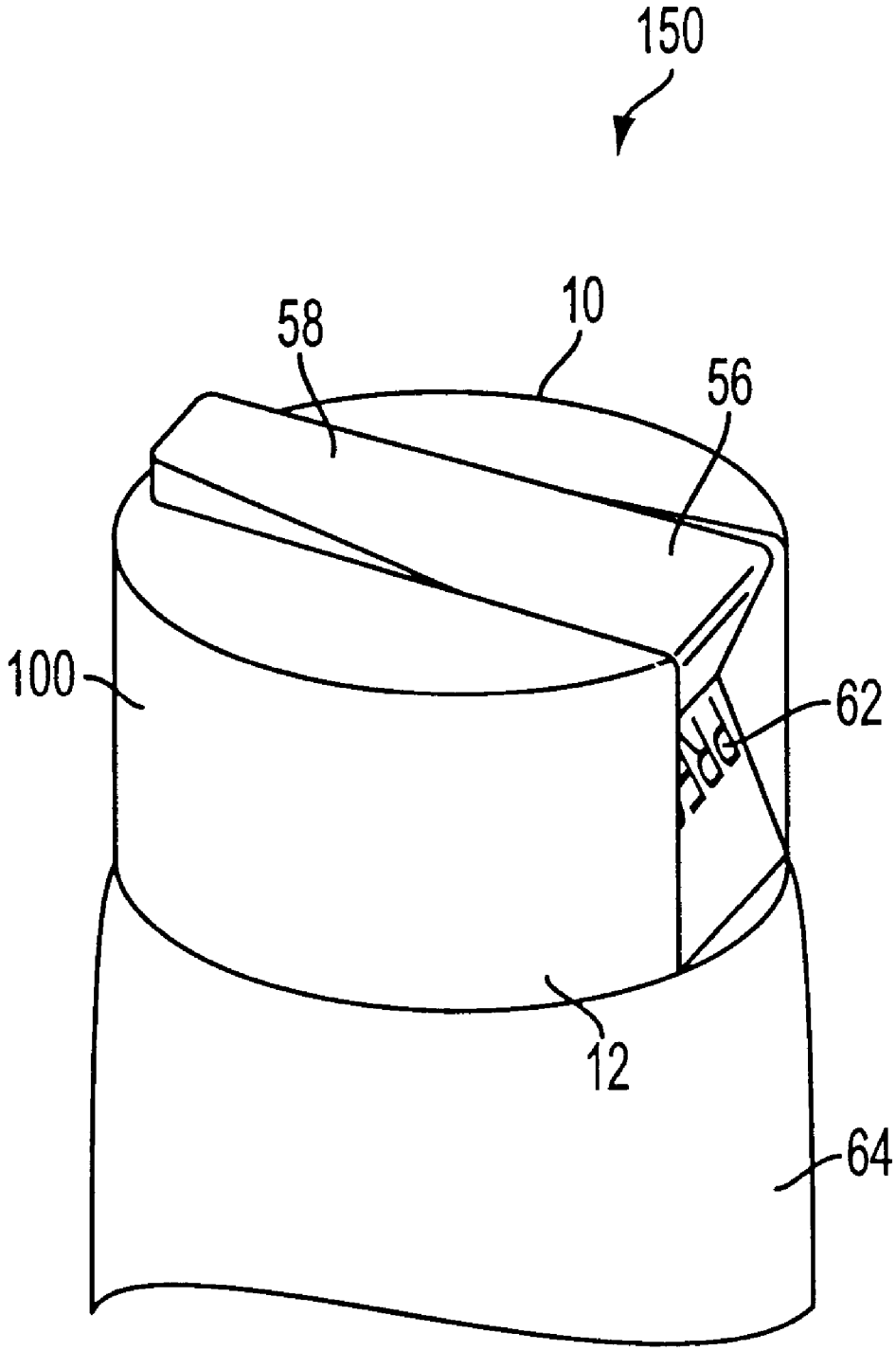
FIG. 6 is a perspective view of the closure of FIG. 1 in the open position in connection with a container.

FIG. 3 shows a cross-section of the closure 100 prior to assembly of the closure for use. The cap 10 includes an outer cylindrical wall or skirt 12 and an inner cylindrical wall 11. The inner wall 11 has a inner wall opening 86 through which the cap 10 fluidly communicates with the contents of a container 64 (FIG. 6). A top portion of the inner wall 11 is connected to a platform 20 and an inner portion of the inner wall 11 has threads 84. The threads 84 engage a threaded portion of the container 64 (FIG. 6). It is to be noted that threads 84 are not required and may be replaced by other suitable forms of interfacing a cap with a container, such as an annular ring for rollable locking engagement. The platform 20 has an aperture 16 and a discharge tube 22 for allowing the contents of the container 64 to exit the container. The platform 20 also connects the inner wall 11 with the outer wall or skirt 12.

Figure 5:
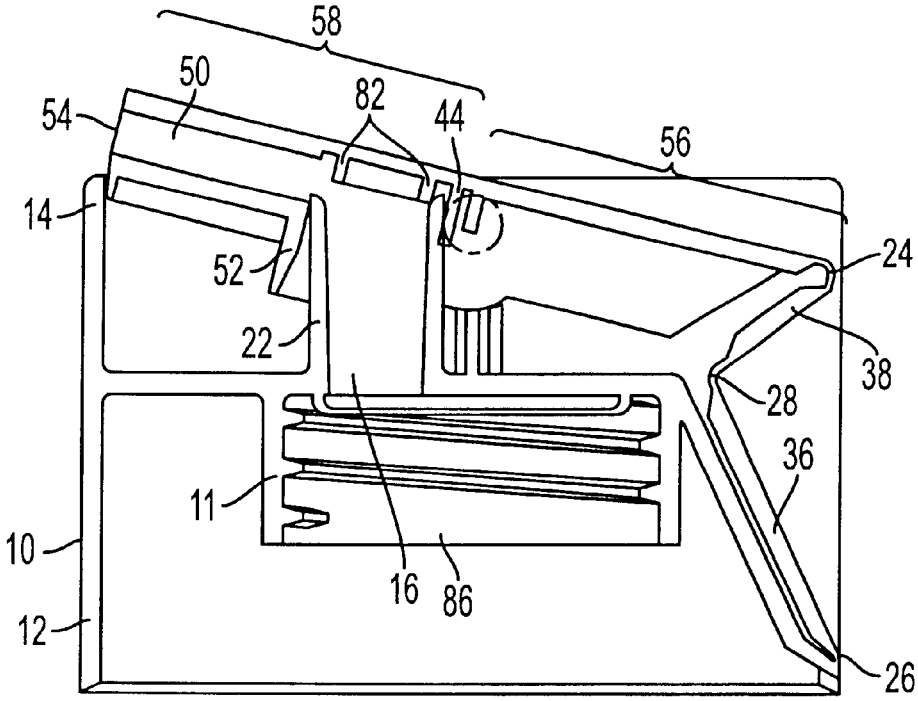
FIG. 5 is a cross-sectional view of an assembled closure like FIG. 1 shown in the open position.

The dispensing lid 40 includes respective lever and conduit portions 56, 58. One end of the lid 40 serves as a lever portion 56 and the opposite end serves as a conduit portion 58. The conduit portion 58 contains a fluid passageway 50 and sits within a recess 21 of the cap 10 when the lid 40 is in a closed position. The fluid passageway 50 is defined by an undersurface 68 of the conduit portion 58 and a passage bottom 70, and it terminates in an dispensing opening 54. As shown in FIG. 5, when the lid 40 is in an open position, the dispensing opening 54 provides an outlet for the fluid passageway 50 by its positioning above a cap lip 14.

Figure 8:
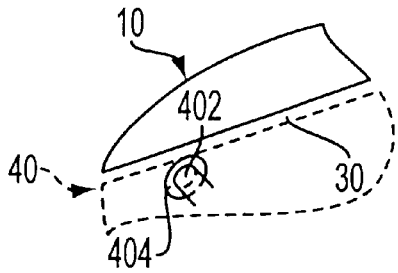
FIG. 8 is a perspective view of a portion of a closure constructed in accordance with another embodiment of the invention.

The dispensing lid 40 includes pivots 46 in the shape of spheres or portions of spheres. The pivots 46 are received in sockets 32 of a top wall 30 of the cap 10. Thus, the lid 40 and the cap 10 are connected by an uncomplicated ball joint construction. It is to be noted that such a ball joint is not required to connect the lid 40 to the cap 10. Alternate embodiments may include one or more trunnions 402 in place of the pivots 46 and swivel recesses 404 in place of sockets 32 formed in the top wall 30, as shown in FIG. 8.

To assemble the closure 100, the dispensing lid 40 is fitted into the recess 21 of the cap 10, and the pivots 46 of the dispensing lid 40 are fitted into the mating sockets 32 of the cap 10. The underguides 72, lateral guides 74, and supports 18 assist in the correct positioning of the lid 40 within the recess 21.

In addition to the pivots 46 and sockets 32, the cap 10 is attached to the dispensing lid 40 by a flexible actuating section 34. The actuating section 34 may include first and second panels 38, 36, respectively, joined by a hinge 28. A top hinge 24 may attach the lid 40 to the first panel 38, the middle hinge 28 may connect the first and second panels 38, 36, and a bottom hinge 26 may attach the second panel 36 to the cap 10. Any or all of the hinges 24, 26, 28 may be living hinges. However, living hinges are not required. Furthermore, first and second panels 38, 36 are not required and the flexible actuating section 34 may include any number of panels, for example one panel, and any number of hinges, for example zero hinges, in accordance with the invention.

Figure 4:
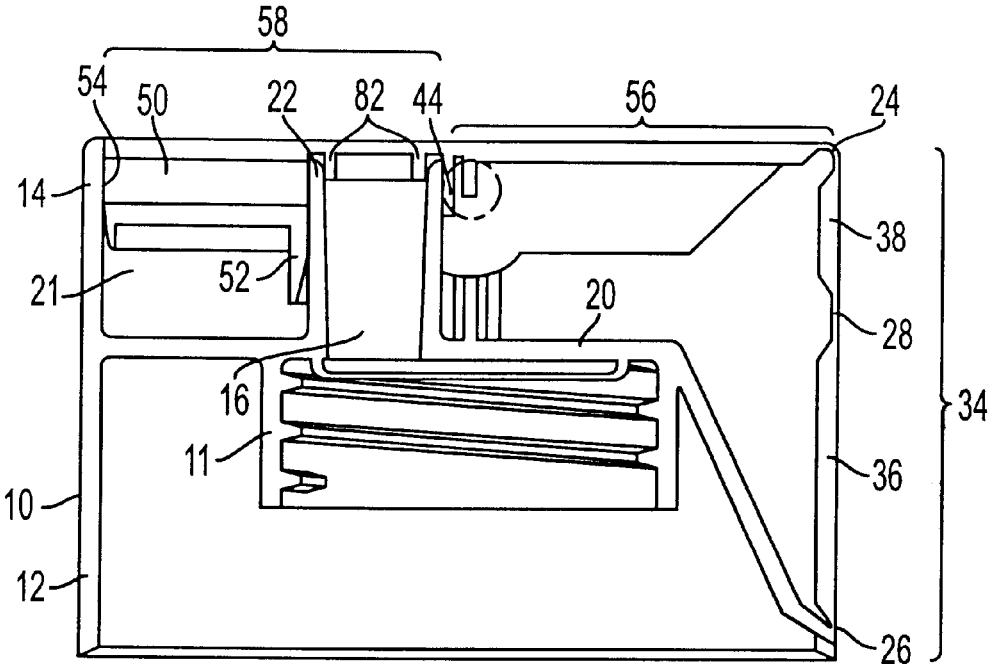
FIG. 4 is a cross-sectional view of an assembled closure like FIG. 1 shown in the closed position.

FIGS. 4 and 5 illustrate the closure 100 in the closed and open positions, respectively. Referring to FIG. 4, when the closure 100 transitions to the closed position, the dispensing opening 54 is disposed within the recess 21 and behind the lip 14 formed from a top portion of the outer wall 12. In addition, an annular seal 82 on the undersurface 68 of the lid 40 engages a top end of the discharge tube 22 to prevent fluid communication between the aperture 16 and the fluid passageway 50.

When pressed, the flexible actuating section 34 exerts a downward force on the lever portion 56 of the dispensing lid 40 that disengages the dispensing lid 40 from the cap 10 and opens the lid 40. The discharge receptacle 44 and annular top and conduit seals 82, 52 are located on the undersurface 68 of the lid 40 at a position between the fluid passageway 50 and the pivots 46. Referring to FIGS. 2 and 3, the annular seal 52 is located on the passage bottom 70 of the fluid passageway 50 on an end adjacent to the discharge tube 22. As shown in FIG. 4, when the closure 100 is in the closed position, the discharge receptacle 44 and the annular seals 52, 82 engage and seal the top portion of the discharge tube 22 when the dispensing lid 40 is received within the recess 21 of the cap 10. As shown in FIG. 5, when the closure 100 is in the open position, the discharge receptacle 44 and the annular seals 52, 82 engage and seal the top portion of the discharge tube 22 to prevent flow other than through the passageway 50.

In operation, the closure 100 is screwed onto the container 64 in a similar manner in which a standard dispensing closure would be applied to a container. In the closed position, the dispensing opening 54 sits behind the cap lip 14. To open the closure 100, a user presses the actuating section 34 (at the side of the closure 100) and the conduit portion 58 of the dispensing lid 40 is flipped upwardly (as illustrated in FIGS. 5–6) from the cap 10 as the lid 40 rotates about the pivots 46. When the closure 100 is in the open position, the contents of the container 64 may flow through the inner wall opening 86, the aperture 16, the discharge tube 22, the passageway 50 and the dispensing opening 54. The flexible actuating section 34 may include a non-slip portion 62 formed on an exterior surface for non-slip actuation of the closure 100 (FIG. 6).

When the lid 40 is in the closed position, the annular seals 52, 82 act to maintain the lid 40 in the closed position by sealing off the top portion of the discharge tube 22. When the lid 40 is in the open position, the annular seals 52, 82 act to maintain the lid 40 in the open position by similarly sealing off the discharge tube 22. The seals 52, 82 are shaped to conform to the inside and outside of the discharge tube 22 and are flexible enough to allow slight deflection when transitioning between the closed and open positions. The annular seal 82 engages a section of the top rim of the discharge tube 22 when the closure 100 is in the closed position, but not when the closure 100 is in the open position. Similarly, the annular seal 52 engages a section of the top rim of the discharge tube 22 when the closure 100 is in the open position, but engages a portion of the discharge tube 22 below the top rim when the closure 100 is in the closed position.

A preferred embodiment of the present invention combines the one-piece side-actuated, side-dispensing closure 100 with the container 64 to form a dispensing system 150, as illustrated in FIG. 6. The walls of the container 64 and the walls 10, 12 of the closure 100 are fluid-tight to preclude flowable materials from exiting the system 150 other than through the closure 100.

Figure 7:
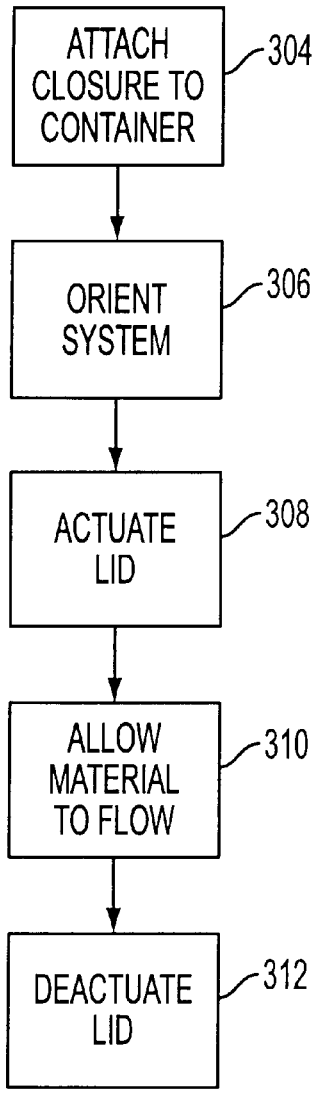
FIG. 7 is a block diagram illustrating a method of using a closure in accordance with an embodiment of the invention.

With reference to FIG. 7, next will be described a method of dispensing flowable materials from the container 64 using the one-piece side-actuated, side-dispensing closure 100. The method includes attaching the closure 100 to the container 64 to form the system 150 for dispensing flowable materials, optionally orienting the system 150 in a desired direction, actuating the flexible actuating section 34 of the system 150, and allowing the contents of the container 64 to flow out of the system 150. Specifically, the method begins by attaching the closure 100 to the container 64 in step 304 to form the closure-container dispensing system 150. Step 304 may include interfacing closure threads 84 with threads on the container 64 by screwing the closure 100 down onto the container 64. In an alternate embodiment, step 304 may include rolling an annular ring on the closure 100 down over a corresponding annular ring on the container 64. A variety of conventional techniques for attaching a closure 100 to the container 64 may be used as is known in the art.

Then, the system 150 may optionally be oriented at step 306 by the user in the desired direction of material flow. Step 306 may include both translation and rotation of the system 150 by the user.

At step 308, the lid 40 is actuated when the user presses the actuating section 34 (at the side of the closure 100) and the conduit portion 58 of the dispensing lid 40 is flipped upwardly (as illustrated in FIGS. 5–6) from the cap 10 about the pivots 46. Because the actuating section 34 is located on a side of the lid 40 opposite the dispensing opening 54, a user may actuate the lid 40 without placing a hand in the area where flowable materials exit the system 150 at the dispensing opening 54. Conventional side-actuated closures are actuated on the same side as the dispensing opening, placing a user's hand in the line of spillage from the system 150.

Flowable materials are allowed to flow at step 310 and exit the system 150. After the flowable materials exit the container 64 through the inner wall opening 86, the materials continue through the aperture 16, the discharge tube 22, the passageway 50, and the dispensing opening 54 to exit the closure 100.

Next, flow is halted when the user so desires. Stopping the flow is done at step 312 by de-actuating the lid 40. De-actuation is accomplished by pressing down on the raised conduit portion 58, causing the closure 100 to transition from an open position to a closed position. Alternatively, flow may be halted by rotating the system 150 upright so that gravity prevents the flowable materials from exiting the system. The method may be repeated by returning to step 304 or 306 when desired.

One advantage of the closure of the invention is that it permits the user to dispense the contents of a tube or "tottle" without inverting the container to actuate the closure. This closure allows the user to simply grasp the container with one hand, actuate the closure using the side-actuator, dispense the contents of the container, and de-actuate the closure, for example by lowering the container against a countertop or other convenient surface. The entire dispensing operation may thus be accomplished without involving more than one hand and without inverting the container.

While the invention has been described in detail in connection with preferred embodiments known at the time, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. For example, the invention may be fabricated from a variety of materials, including but not limited to plastic, glass, aluminum, or steel. Accordingly, the invention is not to be seen as limited by the foregoing description, but is only limited by the scope of the appended claims.

What is claimed as new and desired to be protected by Letters Patent of the United States is:

1. A side-dispensing closure, comprising:

a cap having an inner wall, a platform overlying said inner wall including an aperture, a discharge tube extending from said aperture, and a top wall supported by said platform;

a dispensing lid having a conduit portion with a fluid passageway in fluid connection with said discharge tube, a lever portion connected to said conduit portion, a fulcrum about which said lid rotates, and a connector for pivotally connecting said lid to said top wall; and a flexible actuating section connected between said cap and said dispensing lid, said dispensing lid being connected to an upper end of said flexible actuating section by a top hinge and said cap being connected to a lower end of said flexible actuating section by a bottom hinge, wherein said flexible actuating section is formed to allow transition of said closure from a closed to an open position when a force is applied to said flexible actuating section.

2. The closure of claim 1, wherein said flexible actuating section includes at least first and second panels connected between said cap and said dispensing lid, said dispensing lid being connected to said first panel by said top hinge, said first panel being connected to said second panel by a middle hinge, and said second panel being connected to said cap by said bottom hinge.

3. The closure of claim 2, wherein said top, middle, and bottom hinges are living hinges.

4. The closure of claim 2, wherein said flexible actuating section is located on a side of said closure opposite a dispensing opening of said conduit portion.

5. The closure of claim 1, wherein said top and bottom hinges are living hinges.

6. The closure of claim 5, wherein said flexible actuating section is located on a side portion of said closure.

7. The closure of claim 1, wherein said flexible actuating section is located on a side portion of said closure.

8. The closure of claim 1, wherein said lid further comprises annular seals formed on an undersurface of said lid which sealably engage said discharge tube to prevent fluid flow when said lid is in said closed position and to prevent fluid flow other than through said fluid passageway when said closure is in said open position.

9. The closure of claim 8, wherein said annular seals act to maintain said lid in said closed position or said open position.

10. The closure of claim 1, wherein said platform and said discharge tube are integrally formed and said discharge tube includes a portion of said platform.

11. The closure of claim 1, wherein said inner wall includes threads engageable with corresponding threads.

12. The closure of claim 1, wherein said connector attaches said lid to said cap with at least one bail and joint linkage.

13. The closure of claim 1, wherein said connector attaches said lid to said cap with at least one trunnion and swivel recess linkage.

14. The closure of claim 1, wherein said flexible actuating section includes a non-slip portion formed on an outer surface.

15. The closure of claim 1, wherein said connector attaches said cap to said lid at said fulcrum.

16. The closure of claim 1, wherein said dispensing lid includes a substantially planar upper surface and said fluid passageway is formed beneath said upper surface.

17. A one-piece side-dispensing closure, comprising:

a cap having a skirt connectable with a container, a platform peripherally supported by said skirt and including an aperture, a discharge tube positioned over said aperture, and a top wall upwardly extending from said skirt and said platform;

a dispensing lid having a conduit portion with a fluid passageway connected to said discharge tube, a lever portion connected to said conduit portion, a fulcrum about which said lid rotates, and a connector for pivotally connecting said lid to said top wall; and an actuating section having first and second panels connected between said cap and said dispensing lid, said dispensing lid being connected to said first panel by a top hinge, said first panel being connected to a second panel by a middle hinge, and said second panel being connected to said cap by a bottom hinge, wherein said actuating section is formed to permit transition from a closed to an open position when a force is applied to said first or second panels.

18. The closure of claim 17, wherein said top, middle, and bottom hinges are living hinges.

19. The closure of claim 18, wherein said actuating section is located on a side portion of said closure.

20. The closure of claim 18, wherein said actuating section is located on a side of said closure opposite a dispensing opening of said conduit portion.

21. The closure of claim 17, wherein said actuating section is located on a side portion of said closure.

22. The closure of claim 17, wherein said lid further comprises annular seals formed on an undersurface of said lid which sealably engage said discharge tube to prevent fluid flow when said lid is in said closed position and to prevent fluid flow other than through said fluid passageway when said lid is in said open position.

23. The closure of claim 22, wherein said annular seals act to maintain said lid in said closed position or said open position.

24. The closure of claim 17, wherein said platform and said discharge tube are integrally formed and said discharge tube includes a portion of said platform.

25. The closure of claim 17, wherein said skirt includes threads engageable with corresponding threads on said container.

26. The closure of claim 17, wherein said connector attaches said lid to said cap with at least one bail and joint linkage.

27. The closure of claim 17, wherein said connector attaches said lid to said cap with at least one trunnion and swivel recess linkage.

28. The closure of claim 17, wherein said actuating section includes a non-slip portion formed on an outer surface.

29. The closure of claim 17, wherein said connector attaches said cap to said lid at said fulcrum.

30. The closure of claim 17, wherein said dispensing lid includes a substantially planar upper surface and said fluid passageway is formed beneath said upper surface.

31. A system for dispensing flowable materials, comprising:

a container;

a cap having an inner wall connectable with a container, a platform overlying said inner wall including an aperture, a discharge tube positioned over said aperture, and a top wall supported by said platform;

a dispensing lid having a conduit portion with a fluid passageway connected to said discharge tube, a lever portion connected to said conduit portion, a fulcrum about which said lid rotates, and a connector for pivotally connecting said lid to said top wall; and an actuating section having first and second panels connected between said cap and said dispensing lid, said dispensing lid being connected to said first panel by a top hinge, said first panel being connected to a second panel by a middle hinge, and said second panel being connected to said cap by a bottom hinge, wherein said actuating section is formed to permit transition from a closed to an open position when a force is applied to said first or second panels.

32. The system of claim 31, wherein at least one of said hinges is a living hinge.

33. The system of claim 32, wherein said top, middle, and bottom hinges are living hinges.

34. The system of claim 32, wherein said actuating section is located on a side of said closure opposite a dispensing opening of said conduit portion.

35. The system of claim 32, wherein said actuating section is located on a side portion of said closure.

36. The system of claim 31, wherein said actuating section is located on a side portion of said closure.

37. The system of claim 31, wherein said lid further comprises annular seals formed on an undersurface of said lid which sealably engage said discharge tube to prevent fluid flow when said lid is in said closed position and to prevent fluid flow other than through said fluid passageway when said lid is in said open position.

38. The system of claim 37, wherein said annular seals act to maintain said lid in said closed position or said open position.

39. The system of claim 31, wherein said platform and said discharge tube are integrally formed and said discharge tube includes a portion of said platform.

40. The system of claim 31, wherein said inner wall includes threads engageable with corresponding threads on said container.

41. The system of claim 31, wherein said connector attaches said lid to said cap with at least one ball and joint linkage.

42. The system of claim 31, wherein said connector attaches said lid to said cap with at least one trunnion and swivel recess linkage.

43. The system of claim 31, wherein said actuating section includes a non-slip portion formed on an outer surface.

44. The system of claim 31, wherein said connector attaches said cap to said lid at said fulcrum.

45. The system of claim 31, wherein said dispensing lid includes a substantially planar upper surface and wherein said fluid passageway is formed underneath said upper surface.

46. A method of dispensing flowable materials from a container, comprising:

connecting a one-piece side-dispensing closure to a container containing a flowable material, the dispensing closure having a dispensing lid attached to a cap by a flexible actuating section and pivotally connected to the cap;

applying a force to said actuating section situated opposite a dispensing opening of said lid to transition said lid from a closed position to an open position by causing an arm of said actuating section to move a first lever portion of said lid about a hinge causing a second lever portion of the lid to rotate about a fulcrum; and permitting said flowable material to flow out of said container, through said cap, and out of said lid through said dispensing opening.

47. The method of claim 46, further comprising orienting said container and said closure in a desired direction during said flowing step.

48. The method of claim 46, wherein said flowing step includes flowing said flowable material out of said container through an aperture in a platform overlying an inner wall of said cap, through a discharge tube positioned over said aperture, and through a fluid passageway formed in said dispensing lid prior to flowing out of said lid through said dispensing opening.

49. The method of claim 46, further comprising halting flow of said flowable material out of said container by applying a force to a conduit portion of said dispensing lid to cause said lid to transition from said open position to said closed position by rotating about said fulcrum.

50. The method of claim 49, wherein said halting step includes using annular seals attached to an undersurface of said lid to sealably engage said discharge tube to prevent fluid flow when said lid is in said closed position and to inhibit fluid flow other than through said fluid passageway when said lid is not in said closed position.

* * * * *

UNITED STATES PATENT AND TRADEMARK OFFICE

CERTIFICATE OF CORRECTION

PATENT NO. : 6,460,729 B2
DATED : October 8, 2002
INVENTOR(S) : W. Gordon Beecroft It is certified that error appears in the above-identified patent and that said Letters Patent is hereby corrected as shown below:

Title page,
Item [73], Assignee, change "Doly-Seal Corporation" to -- Poly-Seal Corporation --

Signed and Sealed this

Sixth Day of May, 2003

JAMES E. ROGAN
*Director of the United States Patent and Trademark Office*